United States Patent [19]

Coates

[11] Patent Number: 4,783,009

[45] Date of Patent: Nov. 8, 1988

[54] CALIBRATION ADJUSTMENT OF ELECTROMAGNETIC FUEL INJECTORS

[75] Inventor: Samuel W. Coates, Fond du Lac, Wis.

[73] Assignee: Brunswick Corporation, Skokie, Ill.

[21] Appl. No.: 43,146

[22] Filed: Apr. 27, 1987

[51] Int. Cl.[4] ..... B05B 1/32

[52] U.S. Cl. ..... 239/580; 239/585; 239/451; 251/129.18; 251/129.21

[58] Field of Search ..... 239/580, 585, 453, 533.6, 239/451, 600; 251/129.15, 129.18, 129.21; 123/472

[56] References Cited

U.S. PATENT DOCUMENTS

| | | | |
|---|---|---|---|
| 2,951,647 | 9/1960 | Dreisin | 239/453 |
| 3,450,353 | 6/1969 | Eckert | 239/585 |
| 3,767,123 | 10/1973 | Dreisin | 239/533.6 |
| 4,040,569 | 8/1977 | Knapp | 239/585 X |
| 4,164,326 | 8/1979 | Deckard | 239/585 |
| 4,310,123 | 1/1982 | Te Pastte | 239/585 |
| 4,515,129 | 5/1985 | Stettner | 239/585 X |
| 4,621,771 | 11/1986 | Chiba et al. | 239/585 |
| 4,646,974 | 3/1987 | Sofianek et al. | 239/585 |

FOREIGN PATENT DOCUMENTS

| | | | |
|---|---|---|---|
| 1330181 | 9/1973 | United Kingdom | 239/585 |

OTHER PUBLICATIONS

"Product Profile-TBI", Diesel Equipment Division, General Motors Corporation, Grand Rapids, Michigan. 800164 "Throttle Body Fuel Injection (TBI)-An Integrated Engine Control System", Lauren L. Bowler, SAE Technical Paper Series, 1980, pp. 1-13.

*Primary Examiner*—Douglas C. Butler
*Assistant Examiner*—Mary Beth D. Jones
*Attorney, Agent, or Firm*—Andrus, Sceales, Starke & Sawall

[57] ABSTRACT

A fuel injector includes a housing (2) having fuel upstream inlet and downstream discharge end portions. The discharge end portion is adapted to adjustably receive a valve assembly (9). The valve assembly, in turn, includes a valve poppet (18), seat (17) and biasing primary compression spring (21) arrangement which is adjustable prior to the assembly's insertion into the injector housing. The inlet end portion of the housing includes a magnetic coil (25) and an armature (29) which forms a working gap (33) with the housing. The armature is attached to an actuator (34) which engages the valve assembly. A secondary compression spring (37) is confined between the armature and an upstream fuel inlet member (39) adjustably mounted to the housing. A first or preload adjustment is to the compression of the primary spring in the valve assembly, which is then inserted into the housing. The second adjustment is between the valve assembly and housing, which positions the valve seat as well as setting the upstream working gap. The third or fine adjustment is made between the upstream fuel inlet member and the housing, which preloads the compression of the secondary spring. A calibration device is associated with the upstream fuel inlet for making the third adjustment during fuel flow through the injector.

11 Claims, 2 Drawing Sheets

CALIBRATION ADJUSTMENT OF ELECTROMAGNETIC FUEL INJECTORS

BACKGROUND AND SUMMARY OF THE INVENTION

This invention relates to calibration adjustment of electromagnetic fuel injectors which are utilized in conjunction with two and four cycle spark ignited internal combustion engines. The fuel injectors contemplated here are designed for direct cylinder injection and are intended to operate in the general range of about 100–1500 psi or perhaps lower, as in throttle body injection, but not in the very high diesel injection ranges which may be as high as 10,000 psi.

The development of practical electronic fuel injection systems in recent years has led to a plethora of fuel injector devices designed to provide maximum engine performance. Several of the known devices are disclosed in U.S. Pat. Nos. 3,450,353, 4,040,569 and 4,164,326.

It is important for the injectors to work in harmony with their respective engines, and this requires that the injectors be suitably calibrated to provide the desired fuel volume and time-of-flow for each injection into the engine.

It is an object of the invention to provide a fuel injection concept which permits simplification of calibration procedures over the known devices. It is a further object to provide the ability to easily perform such procedures on a bench-mounted injector prior to installation of the injector on an engine. It is yet another object to provide for coarse as well as fine adjustments to optimize the injector-engine performance. An additional object is to eliminate the need for disconnecting the fuel line from the injector during part of the bench calibration process.

The calibration of fuel injectors can be made in relation to an "injector flow characteristic curve" which plots, for any given injection, the fuel volume vs. the time the injector discharge port is open (commonly called the "pulse width"). See SAE Technical Paper No. 800164, Feb. 25–29, 1980. Proper calibration should be made, taking into account both the slope and position of the curve, which is normally linear.

In accordance with the various aspects of the invention, a fuel injector includes a housing having fuel upstream inlet and downstream discharge end portions. The discharge end portion is adapted to adjustably receive a valve assembly. The valve assembly, in turn, includes a valve poppet, seat and biasing primary compression spring arrangement which is adjustable prior to the assembly's insertion into the injector housing. The inlet end portion of the housing includes the usual magnetic coil and an armature which forms a working gap with the housing. The armature is attached to an actuator which engages the valve assembly. A biasing secondary compression spring is confined between the armature and an upstream fuel inlet member adjustably mounted to the housing.

Three adjustments are contemplated for the device. The first or preload adjustment is to the compression of the primary spring in the valve assembly, which is subsequently inserted into the housing. The second adjustment is between the valve assembly and housing, which positions the valve seat as well as setting the upstream working gap. This modifies the slope of the injector flow characteristic curve. The third adjustment is made between the upstream fuel inlet member and the housing, which preloads the compression of the secondary spring and offsets the position of the injector flow characteristic curve, as desired.

An additional aspect of the invention contemplates the provision of a device associated with the upstream fuel inlet for making the appropriate third adjustment during fuel flow through the injector. In the disclosed embodiment, a calibration device includes a cap which is fit over the fuel inlet and is provided with a fuel inlet port. A slotted tool extends into the cap and engages a corresponding slot in the fuel inlet member in a manner so that fuel can flow through the joint therebetween. Manipulation of the tool adjusts the fuel inlet member relative to the housing while fuel is flowing through the cap and into the injector.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
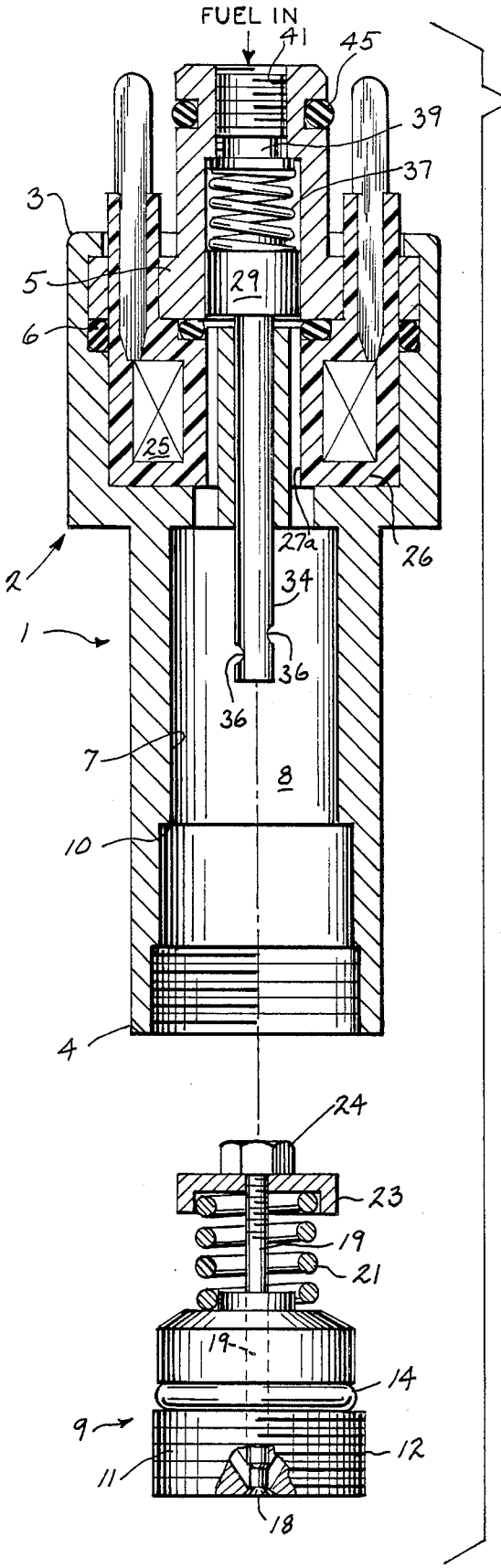
FIG. 1 is an exploded longitudinal view of an electromagnetic fuel injector nozzle assembly constructed in accordance with the concepts of the invention, with parts broken away and in section.
Figure 3:
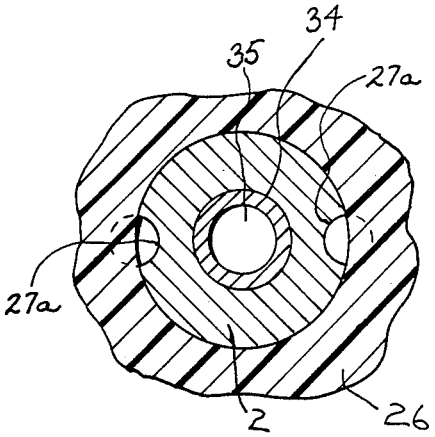
FIG. 3 is an enlarged fragmentary sectional view taken on line 3–3 of FIG. 2.
Figure 2:
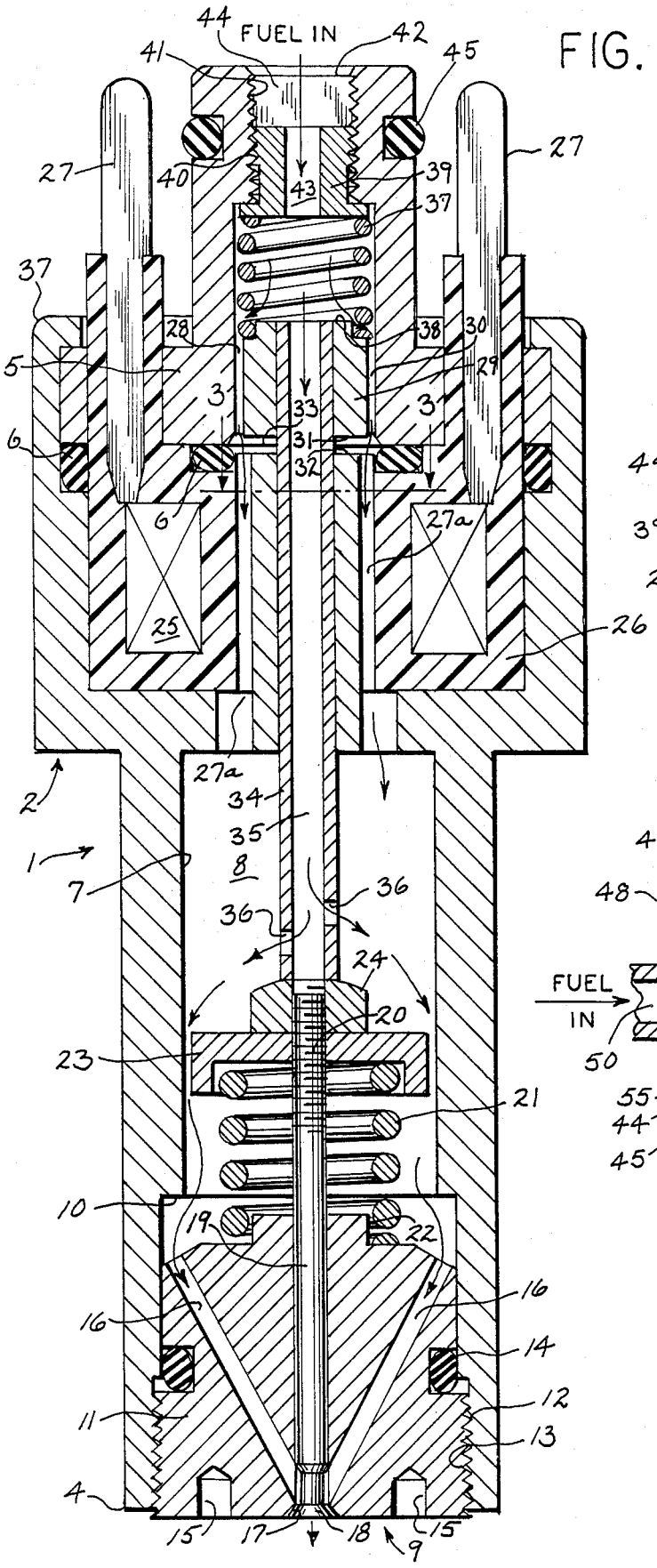
FIG. 2 is a view similar to FIG. 1 with the parts assembled into a completed unit.

Referring to FIGS. 1–3, the fuel injector 1 of the present invention comprises an elongated longitudinal housing 2 having an upstream fuel inlet end portion 3 and a downstream fuel discharge end portion 4. In the embodiment shown, fuel inlet portion 3 may include a separate housing head member 5 which is sealed to the main body of the head by O-rings 6, although the housing could be of unitary construction if desired.

Fuel discharge end portion 4 includes a longitudinal bore 7 forming a fluid flow chamber 8, and is adapted to removably receive a fluid discharge valve assembly 9 therein. Bore 7 is stepped, as at 10, so that the downstream chamber end is enlarged in diameter relative to the upstream internal chamber portion. Valve assembly 9 is shown as comprising an annular valve body 11 having an outer end portion provided with external threads 12 which are adapted to mate with corresponding internal threads 13 disposed on the downstream end of bore 7, for purposes to be described. A suitable O-ring 14 is disposed on valve body 11 upstream of threads 12 for providing a seal between body 11 and bore 7.

Bores 15 are disposed in the outer end of valve body 11 for receiving a spanner wrench (not shown) for adjustment purposes. In addition, body 11 includes fuel flow passages 16 which lead from the inner body end to a downstream valve seat 17 adapted to cooperate with a valve head 18 formed on the end of an elongated longitudinal poppet valve shaft 19 which extends axially through body 11. The inner end of shaft 19 is threaded, as at 20, and is adapted to receive a biasing primary compression spring 21 which is confined between a projection 22 on the inner end of body 11 and a retainer 23 mounted on the shaft and held in place by a nut 24 which is adjustably threaded onto shaft threads 20. The diameter of retainer 23 is less than that of bore 7 to permit fuel to flow therearound.

Fuel inlet end portion 3 of housing 2 is adapted to be mounted to the engine and contains a magnetic coil 25 positioned on a coil support 26, with coil 25 being connected to an external electrical control of any well-known type, not shown, through suitable connectors 27. A pair of fuel flow passages 27*a* are formed between coil 25 and housing 2.

The housing inlet end portion 3 furthermore contains an axial bore 28 of stepped configuration, with an enlarged upstream bore portion containing an armature 29 which is slidingly disposed in the bore in a manner so that fuel can flow through an annular passage 30 therebetween. The downstream end 31 of armature 29 is normally spacingly disposed adjacent an abutment 32 on housing 2 to form a closeable working gap 33 therebetween. Armature 29 is fixedly mounted to a longitudinal tubular actuator 34 which extends downstream through a reduced portion of bore 28 and through chamber 8 to valve assembly 9. Actuator 34 provides an internal fuel flow passage 35 and has a plurality of fuel discharge ports 36 in its wall in the area of chamber 8. Ports 36 are shown as being offset or staggered longitudinally so that the structural strength of the actuator wall is maximized, as compared to the weakening effect which would be caused by transversely opposed ports.

A secondary biasing compression spring 37 of weaker construction than spring 21 is confined within bore 28 between a projection 38 on the upstream end of armature 29 and a retainer screw 39 disposed at the fuel inlet of the injector housing. Retainer screw 39 is provided with external threads 40 which mate with internal threads 41 on the housing inlet passage 42 for adjustment purposes, as will be described. Retainer screw 39 furthermore is provided with a central fuel passage 43 which communicates between inlet passage 42 and actuator passage 35, through spring 37. Furthermore, a transverse adjustment slot 44 is disposed on the outer end of screw 39, with the slot being interrupted by passage 43 to form a pair of slot legs. An O-ring 45 is disposed on the external periphery of the reduced housing wall adjacent retainer screw 39, for purposes to be described.

Figure 4:
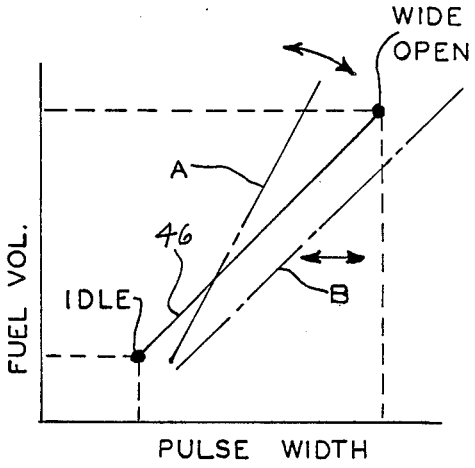
FIG. 4 is a schematic illustration of a typical injector flow characteristic curve.

Turning now to consideration of an injector flow characteristic curve as shown in FIG. 4, the curve plots, for any given injection, the fuel volume vs. the time the injector port (such as between valve seat 17 and valve head 18) is open. This latter is called the "pulse width". Generally two points, idle and wide open engine speeds, are considered, with the curve 46 therebetween preferably being generally linear. It is desired to make bench calibration adjustments to injector 1 so that the slope and lateral position of curve 46 are as desired. In FIG. 4, curve A is a hypothetical curve showing variability of slope. Curve B is a hypothetical curve showing variability of offset or position.

The bench calibration procedure for injector 1 will now be described. The upstream portion of injector 1, as shown in FIG. 1, is suitably secured to a support and inlet 42 is connected through a fuel line to a controllable fuel source, not shown. Valve assembly 9 is initially separate from the remainder of the injector.

Firstly, a coarse preload adjustment is made to primary spring 21 by turning nut 24 on valve shaft 19 of valve assembly 9. Once preloaded, the assembly is then inserted into the enlarged downstream end portion of housing 2.

Assembly 9 is installed by using a spanner wrench (not shown) and threadably coengaging threads 12 and 13. The second adjustment, which is caused by turning the wrench and thus valve body 11, positions the latter axially within housing 2. This, in turn, causes nut 24 to engage the downstream end of actuator 34 so that the latter is also adjusted axially to a desired position. The result is that armature 29 is longitudinally adjusted against the urging force of secondary compression spring 37 to set the normal width of working gap 33, as desired. The slope of fuel flow curve 46 of FIG. 4 is consequently adjusted thereby. It should be noted that while this second adjustment has some effect on the curve position, the effect is minor, with the curve slope being primarily affected.

Finally, retainer screw 39 is threadably rotated to provide an axial adjustment thereof relative to housing 2. This third and fine adjustment sets the amount of preload of secondary compression spring 37, which alters the position of fuel flow curve 46 of FIG. 4, as desired.

It should be noted that during each injection pulse, secondary compression spring 37 assists armature 29 in moving against the force of primary compression spring 21 to cause momentary closing of working gap 33.

During at least part of the calibration process, it is desired to have a fuel line connected to inlet passage 42 so that fuel can be made to flow through the injector, as shown by the arrows in FIG. 2. However, the arrangement shown in FIGS. 1 and 2 requires that the fuel line be disconnected so that access can be had to retainer screw 39 for threaded adjustment thereof.

Figure 6:
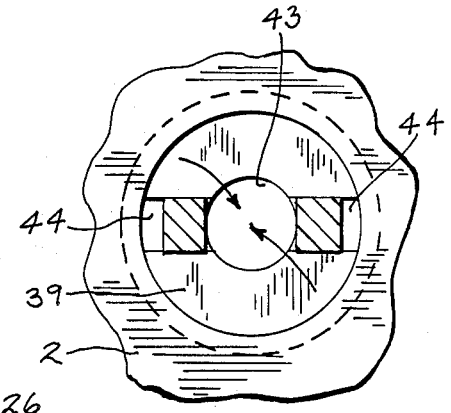
FIG. 6 is a fragmentary sectional view taken on line 6—6 of FIG. 5.
Figure 5:
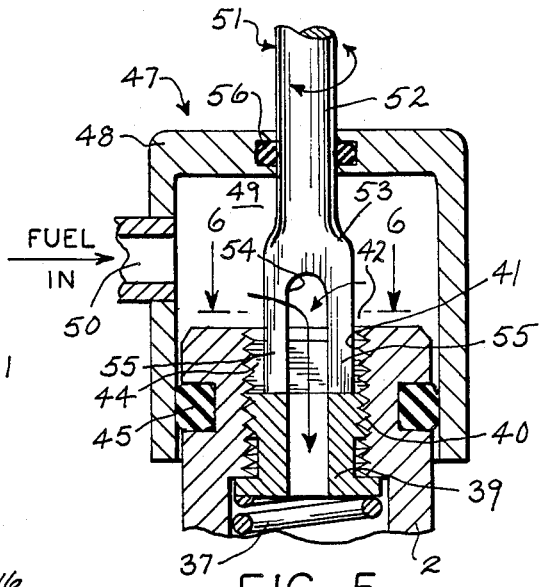
FIG. 5 is a fragmentary sectional view of the upstream inlet end of the injector, with the addition of a calibration device.

The various concepts of the invention contemplate means associated with the fuel inlet portion of the injector for making the third adjustment, even with the fuel line connected and with fuel flowing through the system. For this purpose, and as best shown in FIGS. 5 and 6, a calibration device 47 is provided which includes an inverted cap 48 which is fit down over inlet passage 42 and sealed against the housing as by the O-ring 45. Cap 48 forms a chamber 49 having an inlet port 50 which can be attached to the fuel line.

A manually actuatable calibrating tool 51 is provided, and which includes a rod-like handle 52 which merges into a flattened end 53 having an elongated open-ended slot 54 forming a pair of spaced legs 55. Handle 52 extends inwardly through the outer end of cap 48, and is sealed thereto by an O-ring 56. Flattened inner end 53 is disposed within chamber 49 and is adapted to be manipulated so that the flattened ends of legs 55 are insertable into the slot portions 44 of screw 39. When tool 51 is so positioned, fuel is free to flow through chamber 49 from inlet port 50, and hence through slot 44 and into fuel passage 43. Such flow can thus occur even during calibrating adjustment of retainer screw 39.

After all of the calibrations have been made, device 47 may be easily removed, and then injector 1 may be installed on the desired engine.

Various modes of carrying out the invention are contemplated as being within the scope of the following claims particularly pointing out and distinctly claiming the subject matter which is regarded as the invention.

I claim:

1. An electromagnetic fuel injector for internal combustion engines, said injector comprising, in combination:

(a) a longitudinally extending housing (2) having an upstream fuel inlet portion and a downstream fuel discharge portion, (b) electromagnetic means (25) disposed in said housing, (c) an armature (29) disposed adjacent said electromagnetic means and with said armature being longitudinally moveable in response to actuation of said electromagnetic means, (d) one portion of said armature normally forming a closeable working gap (33) with said housing, (e) first biasing means (37) for urging said armature under a compressive load in a longitudinal direction to narrow said gap, (f) an actuator (34) secured to and extending longitudinally downstream from said armature, (g) valve means responsive to said actuator for permitting injection of fuel from said injector into an engine, said valve means including:

(1) a valve body (11) forming a valve seat (17), (2) and a valve member (18) engageable with said seat, said valve member being connected to said actuator, (h) second biasing means (21) for urging said valve member under a compressive load toward said seat, (i) first adjustment means (24) to set the compressive load of said second biasing means, (j) second adjustment means (11–13) for positioning said valve seat and valve member so that the normal width of said working gap is set through said actuator, (k) and third adjustment means (39–41) to set the compressive load of said first biasing means.

2. The fuel injector of claim 1:

(a) which includes:

(1) a longitudinally extending valve shaft (19) connected to said valve member (18).

(2) and a retainer (23) disposed on said valve shaft, (b) and wherein said second biasing means comprises a compression spring (21) confined between said last-named retainer and said valve body (11), (c) said first adjustment means including a nut (24) threadably mounted on said valve shaft and in engagement with said retainer and said actuator (34).

3. The fuel injector of claim 1 wherein said second adjustment means includes means (12, 13) longitudinally adjustably mounting said valve body (11) to said housing.

4. The fuel injector of claims 1 or 3:

(a) which includes a retainer (39) forming part of said third adjustment means and with said retainer being disposed at the upstream fuel inlet end of said housing, (b) and wherein said first biasing means comprises a compression spring (37) confined between said last-named retainer and said armature, (c) said third adjustment means including means (40, 41) longitudinally adjustably mounting said retainer to said housing.

5. The fuel injector of claim 1, (a) wherein:

(1) said housing (2) includes a bore (7) forming a fuel flow chamber (8), (2) and said actuator (34) comprises a tubular member having a fuel flow passage (35) therein, said actuator extending longitudinally through said chamber, (b) and a plurality of fuel flow ports (36) in said tubular member, said ports connecting said passage with said chamber, (c) said ports being staggered longitudinally along said tubular member.

6. The fuel injector of claim 1 wherein:

(a) said injector is adapted to be calibrated in accordance with an injector flow characteristic curve (FIG. 4) which plots fuel volume vs. pulse width in a generally linear fuel flow curve (46) between idle and wide open engine speeds, (b) said second adjustment means (11–13) forms means to adjust the slope of said fuel flow curve, (c) and said third adjustment means (39–41) forms means to adjust the lateral position of said fuel flow curve.

7. In the fuel injector of claim 1:

(a) a fuel inlet (42) disposed at the upstream inlet end of said housing, (b) a retainer (39) forming part of said third adjustment means and with said retainer being longitudinally adjustably mounted to said housing adjacent said fuel inlet, said retainer having a fuel flow passage (43 in communication with said fuel inlet, (c) a compression spring (37) forming said first biasing means, said spring being confined between said retainer and said armature (29), (d) and means (47, 51) for longitudinally adjusting said retainer while fuel is flowing through said inlet and said passage.

8. The fuel injector of claim 7 wherein said longitudinally adjusting means comprises:

(a) a calibration device (47) having an inverted cap (48) sealingly mounted (45) to said housing, said cap being disposed over said fuel inlet (42) and forming a fuel flow chamber (49) adapted for connection to a source of fuel, (b) and a manually actuatable calibrating tool (51) sealingly passing (56) through said cap and adjustingly engageable with said retainer (39).

9. The fuel injector of claim 8:

(a) in which said retainer (39) is threadably rotatable in said housing to provide said longitudinal adjustment, (b) said retainer having slot means (44) interrupted by said fuel flow passage (43), (c) and said tool (51) includes a flattened inner end portion (53) disposed within said chamber (49), (d) said inner end portion including a pair of spaced legs (55) engageable with said slot means, the space (54) between said legs communicating between said chamber and said fuel flow passage.

10. For use in an electromagnetic fuel injector having a longitudinally extending housing (2) having upstream and downstream end portions and having a fuel inlet (42) disposed at said upstream portion, and with said housing having mounted therein an armature (29) and a longitudinally adjustable retainer (39) confining an armature biasing means (37) therebetween, and with said retainer having a fuel flow passage (43) in communication with said fuel inlet: means (47, 51) for longitudinally adjusting said retainer while fuel is flowing through said inlet and said passage, said longitudinally adjusting means comprising:

(a) a calibration device (47) having an inverted cap (48) adapted to be sealingly mounted (45) to said housing, said cap being adapted to be disposed over said fuel inlet (42) to form a fuel flow chamber (49) adapted for connection to a source of fuel, (b) and a manually actuatable calibrating tool (51) sealingly passing (56) through said cap and adjustingly engageable with a said retainer (39).

11. For use in an electromagnetic fuel injector having a longitudinally extending housing (2) having upstream and downstream end portions and having a fuel inlet (42) disposed at said upstream portion, and with said housing having mounted therein an armature (29) and a longitudinally adjustable retainer (39) confining an armature biasing means (37) therebetween, and with said retainer being disposed longitudinally downstream from said fuel inlet within said housing and having a fuel flow passage (43) in communication with said fuel inlet: means (47, 51) for adjusting said retainer longitudinally and inwardly of said fuel inlet while fuel is flowing through said inlet and said passage, said longitudinally adjusting means comprising:

(a) a calibration device (47) having an inverted cap (48) adapted to be sealingly mounted (45) to said housing, said cap being adapted to be disposed over said fuel inlet (42) to form a fuel flow chamber (49) adapted for connection to a source of fuel, (b) and a manually actuatable calibrating tool (51) sealingly passing (56) through said cap and adjustingly engageable with a said retainer (39).

* * * * *